US009741192B2

(12) United States Patent
Franco Muñoz

(10) Patent No.: US 9,741,192 B2
(45) Date of Patent: Aug. 22, 2017

(54) SELF-TURNING DEVICE WITH THE ABILITY TO MIX AND IDENTIFY BALLS, LOCATED IN A PORTABLE COMPARTMENT WITH AUXILIARY CONTROL ELEMENTS

(71) Applicant: PROINDUMAR, S.L., Madrid (ES)

(72) Inventor: Jesus Franco Muñoz, Madrid (ES)

(73) Assignee: Proindumar, S.L., Madrid (ES)

( * ) Notice: Subject to any disclaimer, the term of this patent is extended or adjusted under 35 U.S.C. 154(b) by 0 days.

(21) Appl. No.: 14/401,817

(22) PCT Filed: May 17, 2013

(86) PCT No.: PCT/EP2013/060214

§ 371 (c)(1),
(2) Date: Nov. 17, 2014

(87) PCT Pub. No.: WO2013/171327

PCT Pub. Date: Nov. 21, 2013

(65) Prior Publication Data

US 2015/0161839 A1 Jun. 11, 2015

(30) Foreign Application Priority Data

May 18, 2012 (EP) ..... 12382183

(51) Int. Cl.
*A63F 5/04* (2006.01)
*G07C 15/00* (2006.01)
*A63F 7/04* (2006.01)

(52) U.S. Cl.
CPC ..... *G07C 15/001* (2013.01); *A63F 7/048* (2013.01)

(58) Field of Classification Search
CPC ..... A63F 5/04; A63F 7/04
USPC ..... 273/144 B
See application file for complete search history.

(56) References Cited

U.S. PATENT DOCUMENTS 465,739 A * 12/1891 Guericke ..... A63F 7/3622 273/110
497,726 A * 5/1893 Phelps ..... A63F 7/048 273/144 B
1,371,194 A * 3/1921 Bird ..... G07C 15/001 273/144 B
2,164,682 A * 7/1939 Keith ..... A63F 9/0406 273/144 B (Continued)

FOREIGN PATENT DOCUMENTS

DE 20 2005 017278 4/2006
WO 84/00115 1/1984

OTHER PUBLICATIONS

"International Search Report for PCT/EP2013/060214 dated Jun. 28, 2013".

*Primary Examiner* — Aarti B Berdichevsky
*Assistant Examiner* — Dolores Collins
(74) *Attorney, Agent, or Firm* — Kramer Amado, P.C.

(57) ABSTRACT

The present invention relates to a self-turning device with the ability to mix and identify balls located in a portable compartment with auxiliary control elements. The device is presented as a whole as a small portable stand-alone device with the ability to perform random drawings. The invention is therefore in the field of devices intended for games of chance and arcade games, such as lotteries, bingo, roulettes, board games, etc.

15 Claims, 5 Drawing Sheets

(56) References Cited

U.S. PATENT DOCUMENTS 2,203,886 A * 6/1940 Zamora ..... G07C 15/001 273/144 A
2,203,896 A * 6/1940 De Boer ..... H01K 1/56 252/181.2
2,375,692 A * 5/1945 Rulfs ..... A63F 5/04 273/144 B
2,490,144 A * 12/1949 Masten ..... A47F 1/08 221/204
D163,323 S * 5/1951 Rioux ..... 273/144 B
2,555,132 A * 5/1951 Hickey ..... A63F 1/06 273/144 A
2,668,717 A * 2/1954 Staub ..... G07C 15/00 221/189
3,140,875 A * 7/1964 Abbott ..... G07C 15/001 221/200
3,870,313 A * 3/1975 Rowman ..... G07F 17/3213 273/143 C
4,066,264 A * 1/1978 Rowman ..... A63F 5/04 273/143 R
4,403,774 A * 9/1983 Turcotte ..... A63F 5/04 273/142 R
4,533,143 A * 8/1985 Albright ..... A63F 7/048 273/144 B
4,616,831 A * 10/1986 Testerman ..... G07C 15/001 273/144 B
4,786,056 A * 11/1988 Dunnigan ..... G07C 15/001 273/144 A
4,822,048 A * 4/1989 Axup ..... G07C 15/001 273/144 B
4,858,933 A * 8/1989 Mink ..... A63F 11/0011 221/203
4,877,246 A * 10/1989 Kropkowski ..... G07C 15/003 193/17
4,961,578 A * 10/1990 Chateau ..... A63F 7/048 273/144 A
4,978,125 A * 12/1990 Trine ..... A63F 7/048 273/144 B
5,102,138 A * 4/1992 Johnson ..... A63F 5/04 273/142 E
5,125,659 A * 6/1992 Garbee ..... A63F 7/048 273/144 A
5,328,173 A * 7/1994 Stern ..... A63F 7/048 273/144 B
5,419,557 A * 5/1995 Kirkland ..... G07C 15/003 273/144 A
6,745,217 B2 * 6/2004 Figotin ..... G06F 7/588 708/250
7,699,316 B2 * 4/2010 Seelig ..... G07F 17/32 273/138.2
7,749,065 B1 * 7/2010 Englman ..... G07F 17/3258 273/121 A
8,079,969 B2 * 12/2011 Rousso ..... A61H 11/02 601/134
8,128,089 B2 * 3/2012 Erickson ..... A63F 3/062 273/138.2
8,322,722 B1 * 12/2012 Criswell ..... A63F 7/048 273/144 B
8,899,585 B2 * 12/2014 Tokue ..... A63F 3/0605 273/138.3
2005/0037830 A1 * 2/2005 Seelig ..... G07F 17/3216 463/17
2009/0001663 A1 1/2009 Franco Muñoz

* cited by examiner

SELF-TURNING DEVICE WITH THE ABILITY TO MIX AND IDENTIFY BALLS, LOCATED IN A PORTABLE COMPARTMENT WITH AUXILIARY CONTROL ELEMENTS

OBJECT OF THE INVENTION

The present invention relates to a self-turning device with the ability to mix and identify balls located in a portable compartment with auxiliary control elements. The device is presented as a whole as a small portable stand-alone device with the ability to perform random drawings.

The invention is therefore in the field of devices intended for games of chance and arcade games, such as lotteries, bingo, roulettes, board games, etc.

BACKGROUND OF THE INVENTION

Drawing mechanisms which operate horizontally, like in the case of casino roulettes, are known. Such drawing mechanisms have completely reliable and random game results, although they must comply with a series of technical requirements both in terms of their manufacture and their installation, including, among others

- high-tech mechanical manufacturing,
- accuracy in assembly, installation and maintenance in the space in which it is to be located,
- the foregoing, in addition to the considerable weight and volume, result in a high financial cost, limiting the use of said mechanism except in those cases for which use is essential.

Therefore, a first technical problem of the devices of the state of the art is the number of requirements for correct operation and the high manufacturing and maintenance costs.

Vertical roulettes with a circumference on the outer perimeter of which there are arranged a series of numbered radial slots and an arrow in the central shaft which can be moved by manual rotation or by being connected to the shaft of a motor driving it, being able to rotate the central arrow or the wheel. This model is well known although it is rather unreliable for the player because both the drive and the subsequent rotation and final stop of the arrow, can be controlled by means of the actual system used. This drawing process is not reliable if random results and an uncontrollable time duration for the result of each drawing are required.

A second technical problem of the drawing devices of the state of the art is the lack of reliable randomness of some in terms of their operating principle.

Therefore, it is necessary to have a device that solves the technical problems raised in the description.

DESCRIPTION OF THE INVENTION

The present invention solves the problems described above by means of a self-turning device with the ability to mix and identify balls according to claim 1 and a system comprising the device according to claim 11. The dependent claims define preferred embodiments of the invention.

The invention describes a self-turning device with the ability to mix and identify balls, which comprises

- a portable containing frame in turn comprising
  - supporting means,
  - a drum resting on the supporting means,

- a motor-driven mechanism comprising a casing and a rotating shaft, the rotating shaft being suitable for transmitting rotational movement to the drum,
  - electronic control elements for the electronic control of the motor-driven mechanism,
  - lottery balls the surface of which comprises a graphic depiction identifying the ball in question, and
  - identification means for identifying the balls;
- the drum being suitable for housing the lottery balls and comprising
  - a hole for the passage of balls located in the perpendicular bisector of the rotating shaft of the drum, and
  - a display-collecting mechanism for displaying-collecting the balls with fixing means for fixing it to the drum in the area of the hole and with two different bodies; the first body is like a half-closed hood with a front mouth (21) in the part inside the drum such that when the drum rotates in one direction the hood repels the balls that hit it, whereas in the other direction of rotation of the drum, the mouth of the hood guides a ball into it, and the second different body at the other end of the mechanism is a display area for displaying balls in the form of a basket such that when at least one ball is guided towards the inside of the hood, the ball drops into the basket through the hole for passage for reading, identification and the subsequent return to the drum, and
- the frame further comprising a sensor located in the lower part suitable for identifying the balls falling into the basket and an electronic display screen for displaying the results, the device characterized in that

- the drum comprises inner extension in the form of a rod suitable for rotating the drum, and
- the motor-driven mechanism
  - is comprised inside the drum and its shaft (3.2) is integrally attached to the rod suitable for rotating the drum transmitting rotation to the latter, and
  - comprises a groove in the casing on which the rotation of the opposite end of the drum to the end which is joined to the inner extension takes place.

The self-turning device comprises a receptacle in the form of a drum, containing and mixing balls, provided with a display-collecting mechanism with the ability to, in an entirely random manner, move, read and identify in each drawing one of the balls contained inside it, to later return the ball to the remaining balls, maintain the probability that the same ball and its number is repeated in the next drawing.

The motor-driven mechanism is attached to the drum such that the shaft of the motor-driven mechanism transmits the movement to the supporting means causing the rotation thereof, and such means in turn are attached to the drum at said end transmitting the movement to it. At the opposite end of the supporting means, the motor-driven mechanism has a support and rotation mechanism for the other end of the drum.

The technical effect and advantage of this last feature is saving space in the interior of the drum suitable for containing the balls, allowing more balls for the probabilities of the drawings, and keeping limited dimensions for the portability of the device.

The motor-driven mechanism comprises a groove in the casing of the motor-driven mechanism allowing the drum to rotate. The casing is arranged such that the drum rests and rotates freely on the groove, the drum rotating freely on the groove on the opposite end of the drum to the end which is joined to the inner extension.

The electronic control elements control the start, stop and change of direction of the rotation of the motor-driven mechanism, sending rotation commands in both directions to the drum for mixing the balls contained therein or separating one of the balls for the display and reading thereof, whichever is appropriate, because the exit of a ball can be controlled depending of the direction of rotation of the drum. The drum has a hole to allow the passage or separation of a ball from the remaining balls, said hole located in the perpendicular bisector of the rotating shaft of the drum.

In the hole for the passage of balls in the drum there is arranged a display-collecting mechanism for displaying-collecting balls, passage being understood as separating a ball from the set of balls and arranging it in the display-collecting mechanism for displaying-collecting balls. Two parts are distinguished in the display-collecting mechanism for displaying-collecting balls, a display basket for displaying balls in its lower part, and a collecting mechanism for collecting balls in its upper part. Outwardly and opposite the hole for the passage of the drum there is a basket with the capacity to house at least one ball of those contained in the drum. At the same time, opposite the hole in the inner part of the drum there is located the collecting mechanism for collecting balls in the form of a hood closed on the sides and having a front access so that a ball can fall into it, and its lower part opens into the basket holding the ball that has been introduced through the entrance of the hood when the drum rotates in one direction of rotation. The configuration of the hood is suitable for repelling or collecting balls according to whether the drum rotates in one direction or the other. Both the basket in the lower part and the ball collector/repeller in the upper part form a display-collecting mechanism that is fixed to the drum with mechanical fixing means.

An additional advantage of using the collecting mechanism in the form of a hood closed on the sides is that the balls can be shuffled when hitting the hood in the rotation of the drum such that the degree of randomness of the drawing is higher.

The outer surface of the balls have a printed depiction corresponding to them, such as a number for example, for the purpose of being visually identified by the player, each of them additionally having identification means or an identification code, such as a barcode for example.

The advantages of this portable stand-alone drawing device with respect to drawing devices of the state of the art are, among others

- more space availability for containing the balls in the interior of the drum, allowing a mayor number of balls for the possibilities of a drawing. All this keeping limited dimensions of the portable containing frame and thus of the drum for the portability of the device, compared to the case of the state of the art where the motor is external to the device, occupying space on both sides of the drum,
- possibility of integrating most of the elements inside the drum without needing to use gears to transmit movement from an external motor to the drum, saving in space and providing a higher degree of portability,
- clear display for the user of the performance of the drawing and the randomness of the results,
- the probability that the same ball and its number is repeated in the next drawing is maintained,
- simplicity and reliability of the mechanisms,
- manufacturing cost-effectiveness because of the reduced number of parts and size,
- portability due to the reduced size of the entire assembly and possibility of stand-alone operation, being able to be used as an individual domestic game,
- ability to be coupled with other systems, such as for example a small "arcade machine"; arcade machine being understood as the type of machine activated by credit, either with coins, tokens, cards with credit, etc.

A second inventive aspect presents an arcade game system characterized in that it comprises:

- at least one device comprising game means, such as for example tic tac toe games,
- at least one device comprising credit element insertion-release means, such as for example coins, credit tokens, credit cards, etc.
- at least one device according to the first inventive aspect.

All the technical features described in this specification (including the claims, description and drawings) can be combined in any manner except the combinations of such mutually exclusive features.

DESCRIPTION OF THE DRAWINGS

These and other features and advantages of the invention will be better understood from the following detailed description of a preferred embodiment in reference to the attached drawings, given only by way of illustrative and non-limiting example.

DETAILED DESCRIPTION OF THE INVENTION

Figure 1:
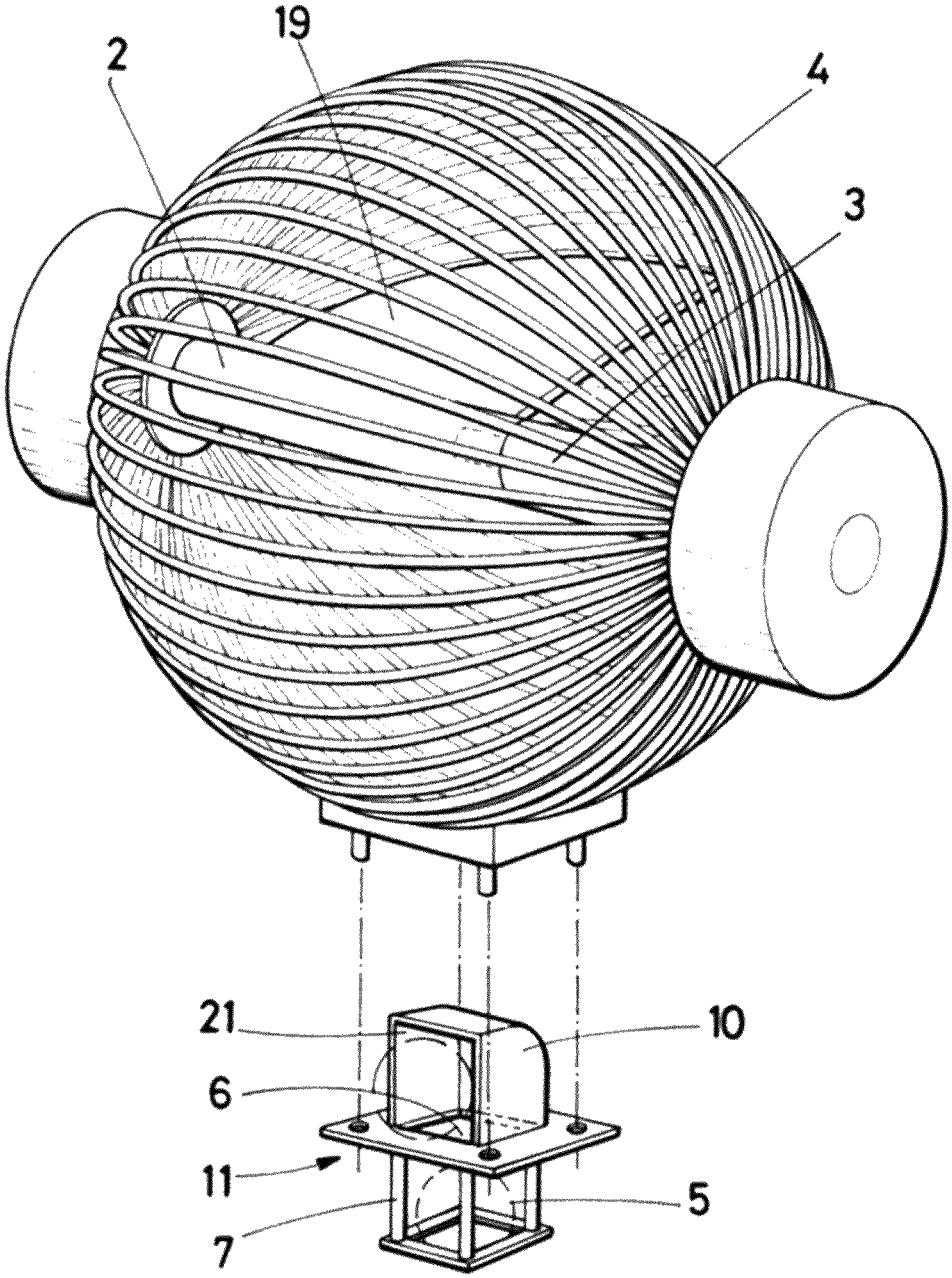
FIG. 1 shows a schematic perspective view of a drum (4) formed by a cage-type structure where the display-collecting mechanism (11) for displaying-collecting balls formed by its two parts, collecting mechanism (10) in the form of a half-closed hood and the display basket (7), are further detailed.

The present invention describes a self-turning device with the ability to mix and identify balls, which comprises

- a portable containing frame (1) in turn comprising
  - supporting means (2),
  - a drum (4) resting on the supporting means (2),
  - a motor-driven mechanism (3) comprising a casing (3.1) and a rotating shaft (3.2), the rotating shaft (3.2) being suitable for transmitting rotational movement to the drum (4),
  - electronic control elements for the electronic control of the motor-driven mechanism (3), lottery balls (5) the surface of which comprises a graphic depiction identifying the ball in question, and identification means for identifying the balls;

the drum (4) being suitable for housing the lottery balls (5) and comprising a hole (6) for the passage of balls (5) located in the perpendicular bisector of the rotating shaft of the drum (4), and a display-collecting mechanism (11) for displaying-collecting the balls (5) with fixing means for fixing it to the drum (4) in the area of the hole (6) and with two different bodies; the first body is like a half-closed hood (10) with a front mouth (21) in the part inside the drum such that when the drum rotates in one direction the hood (10) repels the balls that hit it, whereas in the other direction of rotation of the drum (4), the mouth (21) of the hood (10) guides a ball (5) into it, and the second different body at the other end of the mechanism is a display area for displaying balls (5) in the form of a basket (7) such that when at least one ball (5) is guided towards the inside of the hood (10), the ball (5) drops into the basket (7) through the hole (6) for passage for reading, identification and the subsequent return to the drum (4), and the frame (1) further comprising a sensor (8) located in the lower part suitable for identifying the balls (5) falling into the basket (7) and an electronic display screen (9) for displaying the results, the device characterized in that the drum (4) comprises inner extension (4.1) in the form of a rod suitable for rotating the drum (4), and the motor-driven mechanism (3)

is comprised inside the drum (4) and its shaft (3.2) is integrally attached to the rod suitable for rotating the drum transmitting rotation to the latter, and comprises a groove (3.3) in the casing (3.1) on which the rotation of the opposite end of the drum (4) to the end which is joined to the inner extension (4.1) takes place.

In a device depicted in FIG. 1, the stand-alone portable random drawing device comprises a portable containing frame (1) in turn comprising supporting means (2), a drum (4) the rotating shaft of which rests on the supporting means, a motor-driven mechanism (3) suitable for transmitting movement to the drum (4) through its shaft (3.2) and for supporting the drum (4) through its casing (3.1), electronic control elements for starting, stopping and changing the direction of the rotation of the motor-driven mechanism (3), lottery balls (5) the surface of which comprises a graphic depiction identifying the ball (5) in question, and identification means or code for identifying the balls (5).

At the same time, in this same device, the drum (4) is suitable for housing the lottery balls (5) and comprises a hole (6) for passage located in the perpendicular bisector of the rotating shaft of the drum (4), and a display-collecting mechanism assembly (11) for displaying-collecting the balls (5) suitable for being fixed to the drum (4) in the area of the hole (6). Said display-collecting mechanism or assembly (11) has a display basket (7) outside the drum (4) and the mouth of which is opposite the hole (6), suitable for collecting at least one ball (5) from the drum (4), and a collecting mechanism (10) for collecting balls in the form of a half-closed hood inside the drum (4) with an entry mouth (21) such that when the drum rotates in one direction it repels the balls hitting the collecting mechanism (10), whereas in the other direction of rotation of the drum (4), the mouth of the mechanism guides a ball into it, all such that it allows separating the balls (5) from the drum (4) towards the basket (7) for reading, identification and the subsequent return to the drum (4).

On the other hand, the frame (1) also comprises a sensor (8) located in the lower part suitable for identifying the balls (5) contained in the basket (7) and an electronic display screen (9) for displaying the results. Advantageously, said sensor (8) is an opto-electronic sensor.

In a particular embodiment of the invention, the frame comprises supporting means (2) which in the embodiment are a rod where the drum (4) rests and it is in turn suitable for rotating the drum (4) at one end. This rod suitable for rotating the drum (4) is attached to the drum (4) making it rotate, and the rod is in turn rotated through the shaft (3.2) of the motor-driven mechanism (3). The shaft (3.2) of the motor-driven mechanism (3) is controlled by means of the electronic control elements for starting, stopping and changing the direction of the rotation of the motor-driven mechanism (3).

Figure 3:
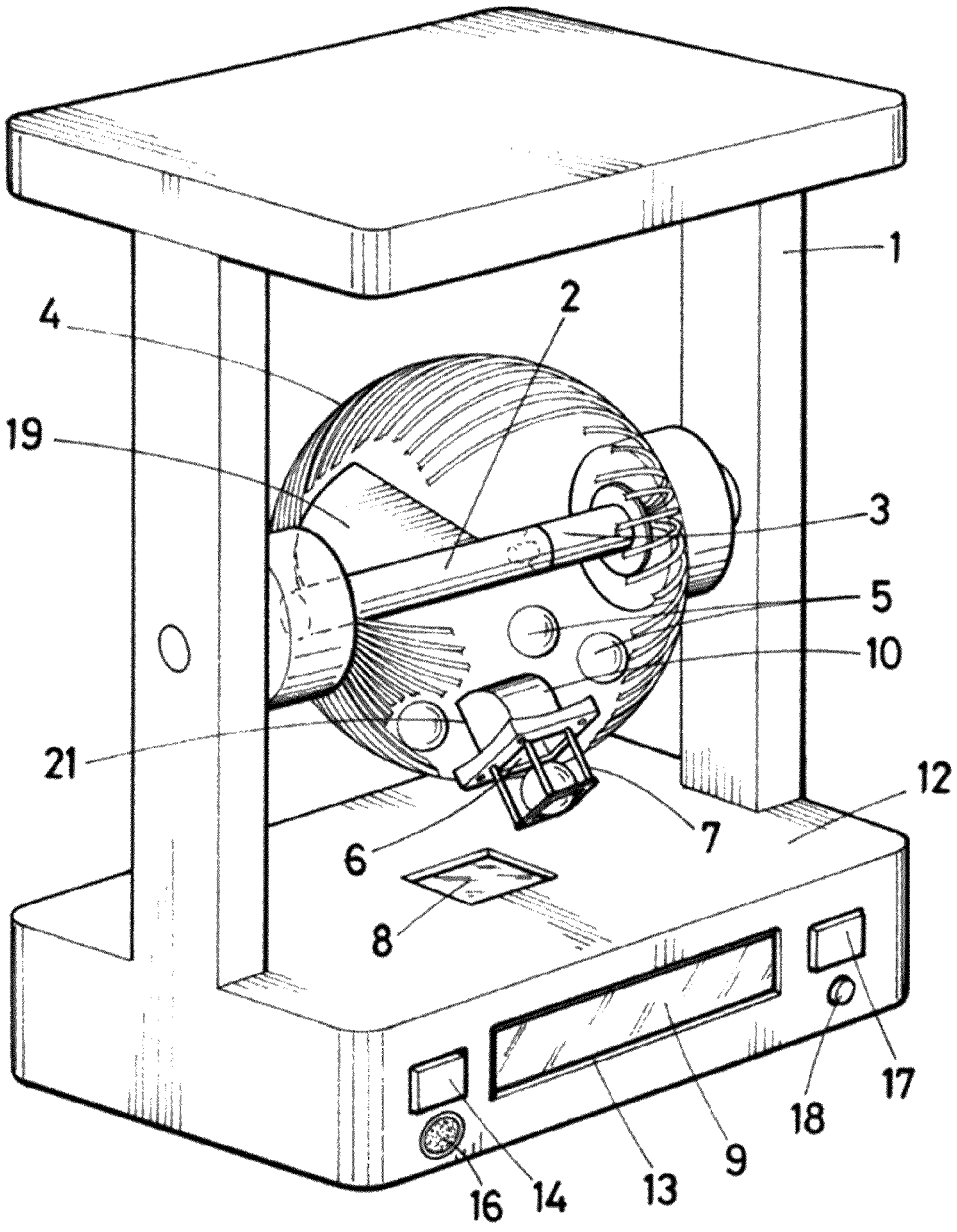
FIG. 3 shows a schematic perspective view of a device where different elements used for forming the device can be seen.

In one embodiment of the invention, the stand-alone portable drawing device rests on a pedestal (12), as the device seen in FIG. 3, comprising:

a window (13) suitable for housing the electronic display screen (9), at least one electronic control button (14) of the motor-driven mechanism (3), a CPU (15) (not shown in the figure) electrically connected to the electronic control elements for starting, stopping and changing the direction of the rotation of the motor-driven mechanism, suitable for receiving data from the exterior and transmitting data towards the interior. The CPU comprises a microprocessor and an internal memory for storing play-related data.

In this embodiment, the button (14) is used to control, set parameters, such as for example the number of turns in the drawing, and to start the motor-driven mechanism (3), and the moment when the user decides to move a ball (5) for identification with the sensor (8) is therefore controlled. Once the sensor (8) has read the ball (5) and the screen (9) shows the result, the user hits the button (14) again to turn the drum (4) again and thus move the ball (5) towards the interior with the remaining balls (5).

Figure 4:
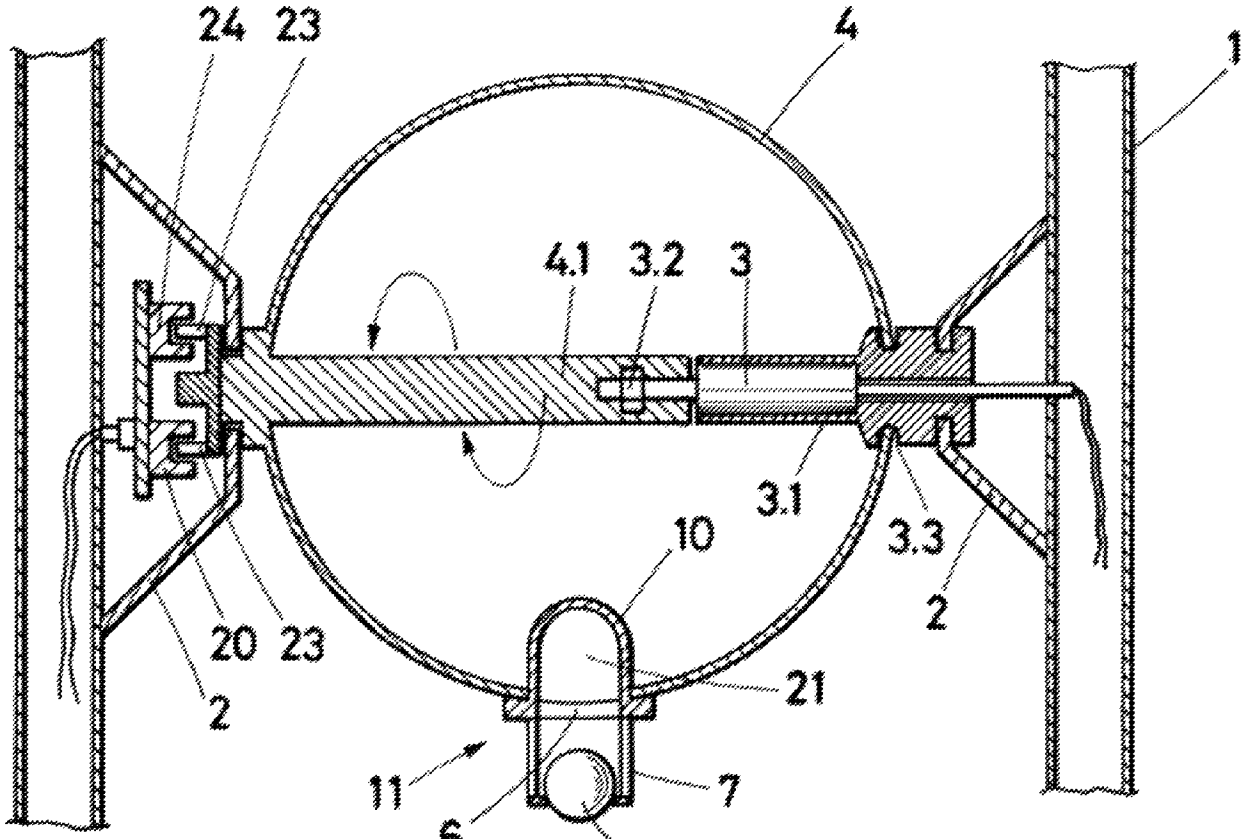
FIG. 4 shows a schematic section view of an embodiment of the invention where the drum (4) comprises the motor-driven mechanism (3) which is attached to the supporting shaft (4.1), forming part of the drum in this particular embodiment, and the shaft (3.2) of the motor-driven mechanism. The casing (3.1) extends into a rotation mechanism comprising a groove (3.3) where the drum (4) rests and rotates.

In one embodiment of the invention, the motor-driven mechanism (3) is comprised inside the drum (4) the casing (3.1) of which extends integrally with the shaft (4.1) of the drum which is formed as part of the drum (4) in FIG. 4, and its rotating shaft (3.2) is integrally attached to the shaft (4.1) of the drum in a single part. As can be seen in FIG. 4 this attachment between the shaft (3.2) of the motor-driven mechanism (3) and the shaft (4.1) of the drum allows the shaft (4.1) to rotate when the shaft (3.2) of the motor rotates, and therefore allows the drum (4) to rotate.

FIG. 4 shows a drum rotation sensor (20) and a drum stop sensor (24). Optical sensors, also called "optos", counting the turns and controlling the stops by means of turn control flanges (23) attached to the shaft (4.1) of the drum and integrally rotating with it, are used in this particular embodiment. Once every two times a turn control flange (23) is detected by the rotation sensor (20), the latter counts a turn and the CPU computes the number of turns. This embodiment is an alternative in which the motor-driven mechanism (3) is in the form of a rod, advantageously meaning that it can be used as part of the shaft (4.1) of the drum by using the casing (3.1) in the form of a rod (FIG. 4). In this particular case the casing (3.1) supports the drum (4) which is not fixed on it but rather rotates freely on a groove (3.3) provided for that purpose on the casing (3.1). In FIG. 4, the supporting means (2) are two side supports where the drum is supported.

The movement of the shaft (3.2) of the motor-driven mechanism (3) thereby causes the movement of the shaft (4.1) of the drum, and the latter causes the drum (4) to move on the left end. On the right end in FIG. 4, the drum (4) rotates on the mentioned groove (3.3) provided in the casing (3.1).

Figure 5:
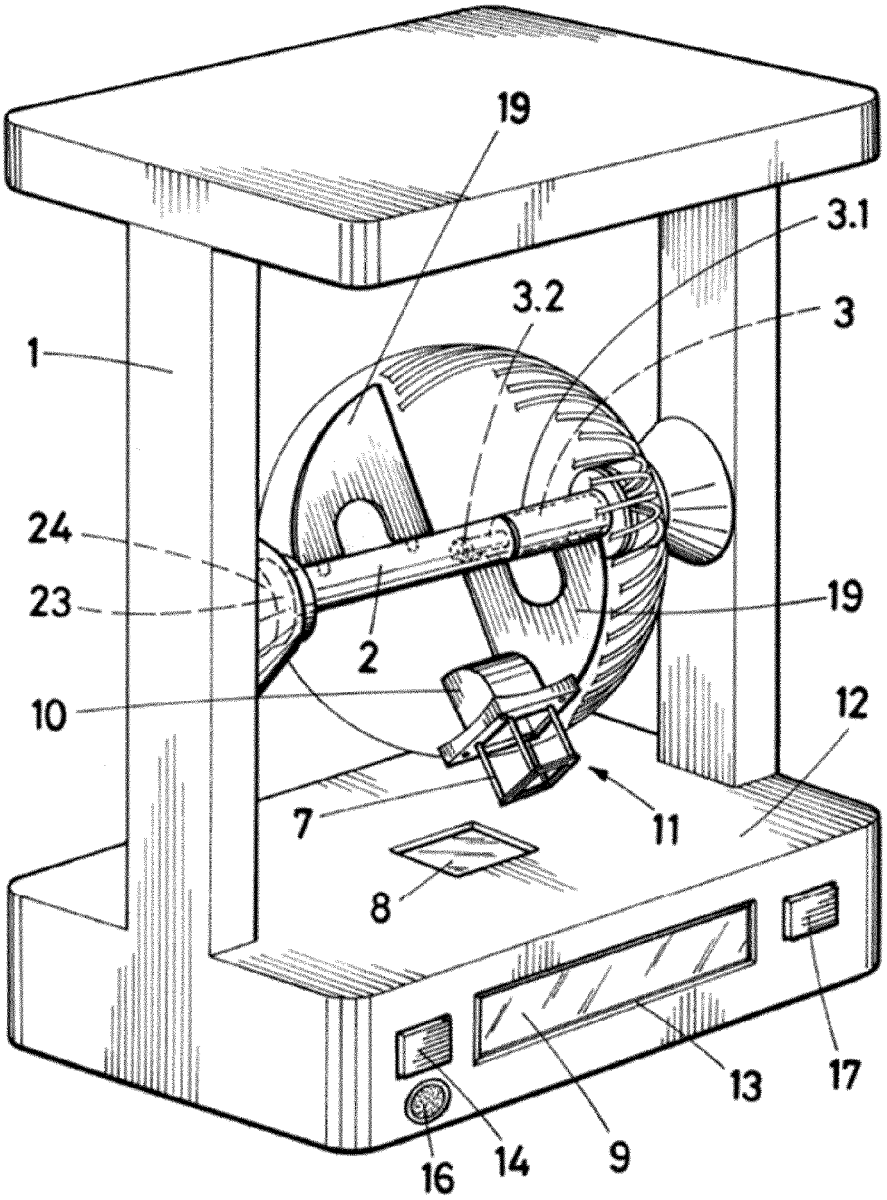
FIG. 5 shows a schematic perspective view of an embodiment of the invention where different elements used for forming the device can be seen.

In FIG. 5, the left end of the drum (4) is attached to a rod (2) forming the supporting means (2) in this embodiment and is in turn suitable for rotating the drum (4). The drum (4) rotates with the rod (2) which receives the rotational movement by means of the shaft (3.2) of the motor-driven mechanism (3). The movement of the shaft (3.2) of the motor-driven mechanism (3) thereby causes the movement of the drum (4) through the rod (2).

In a device with the ability to perform random drawings, the drum (4) is formed by a cage-type structure. This embodiment can be seen in FIG. 1. This figure also shows the display-collecting mechanism or assembly (11) for displaying-collecting balls (5) with its two different parts: the outer basket (7) and collecting mechanism (10) in the form of a half-closed hood with a side entrance (21). The mechanical fixing means attaching the mechanism (11) to the drum (4) in the area of the hole (6) are also shown. In an embodiment variant shown for this purpose in FIG. 5, the half-closed hood (10) has a curved outline.

In one embodiment of the invention, the drum (4) is formed by a transparent material.

In one embodiment, the pedestal (12) further comprises a speaker (16) for emitting possible audible messages to the user.

In one embodiment, the pedestal (12) further comprises an additional button (17) for requesting data, such as the play summary, results of previous games, etc.

In one embodiment, the pedestal (12) further comprises a data in/out connector (18) with respect to the CPU (15) which allows sending data about the results of the drawings to another arcade device. The device has hardware and software means and a microcontroller for controlling the entire operation, accounting and play filing, play mode choice, and data in/out collector (18) for a possible connection and control from the exterior.

In one embodiment, the pedestal (12) further comprises coupling and/or fixing means for coupling and/or fixing to another arcade device, preferably an "arcade machine", arcade machine being understood as the type of game machine activated by credit, either with coins, tokens, cards with credit, etc.

In one embodiment of the invention, the sensor (8) located in the lower part of the portable frame suitable for electrically identifying the balls (5) falling into the basket (7) is a barcode reader (8) and the identification means or code for identifying lottery balls (5) is a barcode.

In one embodiment of the invention, the barcode reader (8) is located on a support for the barcode reader (8). In contrast, as can be seen in FIG. 4, the reader can be built into the pedestal (12) without needing to use a support.

In one embodiment of the invention, the display basket (7) of the drum (4) has dimensions such that it is able to house a single ball (5). It is thus assured that only one ball enters the basket (7), preventing user confusion when seeing two winning balls instead of a single ball which is what will be displayed on the screen (9).

In one embodiment of the invention, the display basket (7) of the drum (4) has dimensions tales such that it is able to house up to two balls (5). It is thus assured that two balls enter the basket (7): one of them indicating units and the other indicating tens. The technical advantage provided by this embodiment is that only twenty balls are needed for drawings in which the purpose is to obtain results between "00" and "99". In other words, two sets of balls (5) from number "0" to number "9" are needed, with the subsequent advantages of:

- smaller drum size,
- lower number of balls (5) to be replaced during device maintenance,
- lower cost.

In the case where the embodiment comprises a basket (7) with a capacity for two balls (5), the identification means for identifying the balls (5) are, by way of example, one of the following variants:

- two barcodes readers (8) placed on respective supports on the pedestal such that they are opposite the basket at different heights, one on top of the other, and each one being suitable for identifying a ball, one identifying units and the other identifying tens, or
- an RFID (Radio Frequency Identification) sensor placed under the basket (7) inside a pedestal (12) which identifies both balls and distinguishes them by proximity thereto.

In one embodiment of the invention, the drum (4) further comprises a blade (19) for shuffling the balls (5). Advantageously, the blade (19) has the form of a quarter-circular arc. This blade is seen in FIG. 4 and rotates driven by the movement of the shaft of the motor-driven mechanism (3) and it is supported by the supporting rod (2) of the drum (4).

In one embodiment of the invention, the drum (4) comprises two blades (19) for shuffling the balls (5), having the form of a quarter-circular arc supported on the supporting rod (2) and comprising a gap (26) in the part supported on the rod (2). These blades (19) are shown in FIG. 6 and comprise gaps (26) for giving balls (5) greater mobility in the movement of the drum (4), and therefore greater randomness to the result of the drawing.

In one embodiment of the invention, the device is suitable for obtaining combinations of several figures in successive drawings because it memorizes in an internal memory partial play-related data such that it can obtain combinations of numbers randomly to play official lottery drawings.

Figure 2:
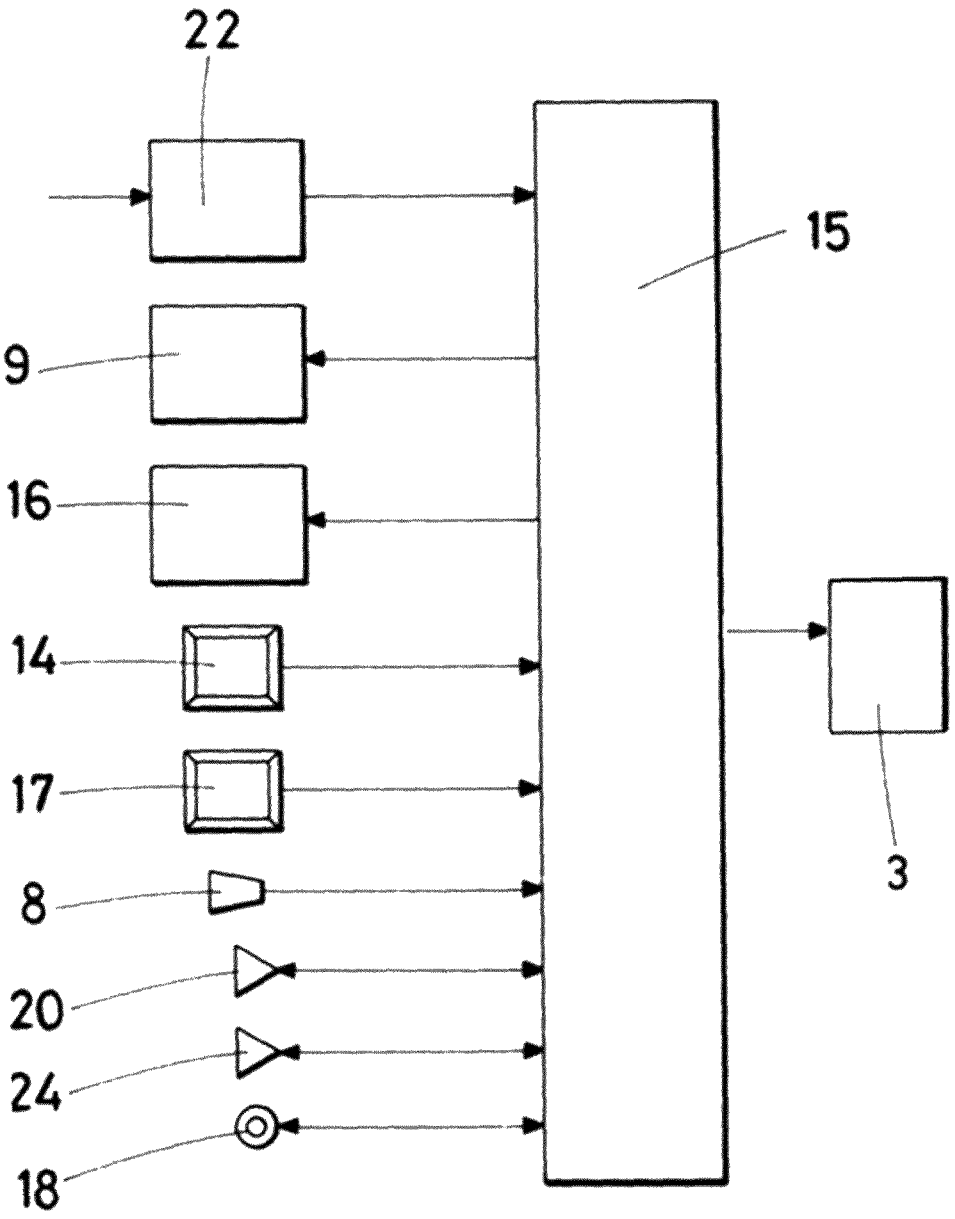
FIG. 2 shows a logic scheme of connections of different electronic control elements for the electronic control of the device.

FIG. 2 shows the functional units of an embodiment of the invention and the direction of the commands from and towards the CPU (15) of each of them. FIG. 2 specifically shows:

- power source (22),
- CPU (15).
- screen (9),
- speaker (16),
- button (14),
- additional button (17) or auxiliary button for accessing accounting data and files,
- barcode reader (8),
- motor-driven mechanism (3),
- drum turn passage sensor (20) or drum stop reference sensor,
- drum stop sensor (24),
- data in/out connector (18) with respect to the CPU.

As indicated above, FIG. 5 shows an embodiment of the invention where the motor-driven mechanism (3) is comprised inside the drum (4) and its rotating shaft (3.2) is integrally attached to the supporting rod (2) and in turn suitable for rotating the drum (4), and where the drum (4) comprises two blades (19) for shuffling the balls (5) having the form of a quarter-circular arc supported on the supporting rod (2) and comprising a gap (26) in the part supported on the rod (2). This embodiment particularly has the following advantages:

capacity to contain a determined a number of balls (5), not less than of 50, the balls (5) are not small so they can be easily seen, it is all contained in a portable drum (4) with small dimensions, the motor-driven mechanism (3) integrally attached to the rod (2) lacks pinions and gear rings, and no special adjustments are needed.

In one embodiment of the invention, an arcade machine or a game system comprising a self-turning device according to any of the preceding embodiments is presented.

The following reference numbers have been used in the embodiments of the invention described throughout the description:

1. portable frame,
2. supporting means
3. motor-driven mechanism,
3.1. casing of the motor-driven mechanism,
3.2. shaft of the motor-driven mechanism,
3.3. groove on the casing (3.1) allowing the drum to rotate freely,
4. drum,
5. balls,
6. hole for the passage of balls,
7. display basket,
8. identification sensor,
9. display screen,
10. collecting mechanism in the form of a half-closed hood,
11. collecting-display mechanism or assembly,
12. pedestal,
13. window,
14. button for starting and controlling plays and drawings,
15. CPU,
16. speaker,
17. auxiliary button for accessing accounting data and files,
18. connector for passing data to the CPU by remote control,
19. blade for shuffling balls arranged integrally with the rod suitable for rotating the drum (4),
20. drum turn passage sensor,
21. front void or aperture of the collecting mechanism in the form of a half-closed hood,
22. power source,
23. turn control flanges,
24. drum stop sensor.

The invention claimed is:

1. A self-turning device with the ability to mix and identify balls with identification marks, which comprises a portable containing frame in turn comprising supporting means, a drum adapted to contain said balls, said drum resting on the supporting means, a motor-driven mechanism comprising a casing and a rotating shaft, the rotating shaft being suitable for transmitting rotational movement to the drum, electronic control elements for the electronic control of the motor-driven mechanism, and identification means for identifying the balls;

the drum comprising a hole for the passage of balls located in the perpendicular bisector of the rotating shaft of the drum, and a display-collecting mechanism for displaying-collecting the balls with fixing means for fixing it to the drum in the area of the hole and with two different bodies;

the first body is like a half-closed hood with a front mouth in the part inside the drum such that when the drum rotates in one direction the hood repels the balls that hit it, whereas in the other direction of rotation of the drum, the mouth of the hood guides a ball into it, and the second different body at the other end of the mechanism is a display area for displaying balls in the form of a basket such that when at least one ball is guided towards the inside of the hood, the ball drops into the basket through the hole for passage for reading, identification and the subsequent return to the drum, and the frame further comprising a sensor located in the lower part suitable for identifying the balls falling into the basket and an electronic display screen for displaying the results, the device characterized in that the drum comprises an inner extension in the form of a rod suitable for rotating the drum, the inner extension being formed as part of the drum, and the motor-driven mechanism is comprised inside the drum, which casing comprises a groove, wherein the rotating shaft of the motor-driven mechanism is connected with the inner extension, such that the connection between the rotating shaft and the inner extension of the drum, allows the inner extension to rotate when the shaft of the motor rotates, thus allowing the drum to rotate, and the groove of the casing supports the drum which is not fixed on the groove and allows the drum to rotate freely relative to the casing.

2. The self-turning device according to claim 1, characterized in that the sensor located in the lower part suitable for identifying the balls falling into the basket is a barcode reader and the identification means for identifying the balls are a barcode.

3. The self-turning device according to claim 2 characterized in that the display basket of the drum has dimensions with capacity to house up to two balls.

4. The self-turning device according to claim 1, characterized in that the drum is formed by a cage-type structure.

5. The self-turning device according to claim 1, characterized in that the drum is formed by a transparent material.

6. The self-turning device according to claim 1, characterized in that the frame rests on a pedestal comprising:

a window suitable for housing the electronic display screen at least one electronic control button of the motor-driven mechanism, a CPU electrically connected to the electronic control elements for starting, stopping and changing the direction of the rotation of the motor-driven mechanism, suitable for receiving data from the exterior and transmitting data from the interior.

7. The self-turning device according to claim 6, characterized in that the pedestal comprises a data in/out connector with respect to the CPU.

8. The self-turning device according to claim 6, characterized in that the pedestal comprises coupling and/or fixing means for coupling and/or fixing to another device, preferably an "arcade machine".

9. The self-turning device according to claim 7, characterized in that the pedestal comprises coupling and/or fixing means for coupling and/or fixing to another device, preferably an "arcade machine".

10. The self-turning device according to claim 1, characterized in that the drum comprises a blade for shuffling the balls.

11. The self-turning device according to claim 1, characterized in that the drum comprises two blades for shuffling the balls having the form of a quarter-circular arc supported by the rod suitable for rotating the drum, the blades comprising gaps suitable for allowing the passage of balls.

12. The self-turning device according to claim 1, characterized in that the display basket of the drum has dimensions with capacity to house up to two balls.

13. An arcade game system, characterized in that it comprises:

at least one device comprising game means, at least one device comprising credit element insertion-release means, at least one device according to claim 1.

14. A self-turning device with the ability to mix and identify balls with identification marks, which comprises:

a portable containing frame in turn comprising:

a rotatable rod, a drum adapted to contain said balls, said drum being fixed to the rotatable rod, the rotatable rod being positioned on an axis of the drum, a motor-driven mechanism comprising a casing within the drum and a rotating shaft connected with the rotatable rod, the rotating shaft being adapted to rotate the rotatable rod relative to the casing, wherein the casing comprises a groove, the groove of the casing supporting the drum, wherein the drum is adapted to rotate freely on said groove, electronic control elements for the electronic control of the motor-driven mechanism, and identification means for identifying said balls;

the drum comprising:

a hole for the passage of balls located in the perpendicular bisector of the rotating shaft of the drum, and a display-collecting mechanism for displaying-collecting the balls fixed to the drum in the area of the hole and with two different bodies; the first body is like a half-closed hood with a front mouth in the part inside the drum such that when the drum rotates in one direction the hood repels the balls that hit it, whereas in the other direction of rotation of the drum, the mouth of the hood guides a ball into it, and the second different body at the other end of the mechanism is a display area for displaying balls in the form of a basket such that when at least one ball is guided towards the inside of the hood, the ball drops into the basket through the hole for passage for reading, identification and the subsequent return to the drum, and the frame further comprising a sensor located in the lower part suitable for identifying the balls falling into the basket and an electronic display screen for displaying the results.

15. A self-turning device with the ability to mix and identify balls with identification marks, which comprises:

a portable containing frame in turn comprising:

a rotatable rod, a drum adapted to contain said balls, said drum being fixed to the rotatable rod, the rotatable rod being positioned on an axis of the drum, a motor-driven mechanism comprising a casing within the drum and a rotating shaft connected with the rotatable rod, the rotating shaft being adapted to rotate the rotatable rod relative to the casing, wherein the casing comprises a groove, the groove of the casing supporting the drum, wherein the drum is adapted to rotate freely on said groove, electronic control elements for the electronic control of the motor-driven mechanism, and identification means for identifying said balls;

the drum comprising a hole for the passage of balls located in the perpendicular bisector of the rotating shaft of the drum, and a display-collecting mechanism for displaying-collecting the balls with fixing means for fixing it to the drum in the area of the hole.

* * * * *